US007176774B2

(12) United States Patent
Coleman, Jr. et al.

(10) Patent No.: US 7,176,774 B2
(45) Date of Patent: Feb. 13, 2007

(54) DIFFERENTIAL MODE INDUCTOR WITH A CENTER TAP

(75) Inventors: William E. Coleman, Jr., Clearwater, FL (US); Fonzie K. Sanders, Clearwater, FL (US); Christopher T. Yates, II, St. Petersburg, FL (US)

(73) Assignee: Raytheon Company, Waltham, MA (US)

( * ) Notice: Subject to any disclaimer, the term of this patent is extended or adjusted under 35 U.S.C. 154(b) by 150 days.

(21) Appl. No.: 10/838,898

(22) Filed: May 4, 2004

(65) Prior Publication Data

US 2005/0248428 A1 Nov. 10, 2005

(51) Int. Cl.
*H01F 5/00* (2006.01)

(52) U.S. Cl. ..... 336/200

(58) Field of Classification Search ..... 336/65, 336/83, 150, 192, 200, 232; 257/531; 363/56.02, 363/56.06

See application file for complete search history.

(56) References Cited

U.S. PATENT DOCUMENTS

| | | | | |
|---|---|---|---|---|
| 4,096,443 A | | 6/1978 | Gilson | 330/267 |
| 4,193,048 A | | 3/1980 | Nyhus | 333/26 |
| 4,609,879 A | | 9/1986 | Flachenecker et al. | 330/276 |
| 5,119,059 A | | 6/1992 | Covi et al. | 336/175 |
| 5,155,676 A | * | 10/1992 | Spreen | 363/126 |
| 5,168,440 A | * | 12/1992 | Spreen | 363/126 |
| 5,747,981 A | | 5/1998 | Callanan | 323/362 |
| 5,892,425 A | * | 4/1999 | Kuhn et al. | 336/200 |
| 6,268,778 B1 | | 7/2001 | Mucke et al. | 331/117 R |
| 6,356,182 B1 | | 3/2002 | Nagashima | 336/200 |
| 6,628,188 B2 | * | 9/2003 | Iida et al. | 336/200 |
| 6,803,849 B2 | * | 10/2004 | Lowther | 336/200 |
| 2003/0156003 A1 | | 8/2003 | Sortor | 336/200 |

FOREIGN PATENT DOCUMENTS

| | | |
|---|---|---|
| DE | 100 58 295 A1 | 5/2002 |
| JP | 62252112 | 11/1987 |
| JP | 2002260927 | 9/2002 |

* cited by examiner

*Primary Examiner*—Tuyen T Nguyen
(74) *Attorney, Agent, or Firm*—Baker Botts L.L.P.

(57) ABSTRACT

A differential mode inductor includes a first inductor lead that receives a current. A first arm receives the current from the first inductor lead. A center tap receives the current from the first arm. A second arm receives the current from the center tap. The second arm is substantially parallel to the first arm. The current in the first arm flows in the same direction as the current in the second arm. A second inductor receives the current from the second arm.

10 Claims, 2 Drawing Sheets

DIFFERENTIAL MODE INDUCTOR WITH A CENTER TAP

TECHNICAL FIELD

This invention relates generally to the field of semiconductors and more specifically to a differential mode inductor with a center tap.

BACKGROUND

Pre-distortion is used to compensate for the non-linearity of a power amplifier in order to reduce the non-linearity effects in an amplified signal. Pre-distortion may be improved by reducing the electrical memory of the power amplifier.

Known techniques attempt to minimize electrical memory by reducing the common mode impedance at the drain or collector of the transistor of a power amplifier. According to one known technique, a first wire is attached between the output terminals of the transistor to form a differential mode inductor. A second wire is attached to the center point of the first wire to form a common mode point to bring in a DC bias voltage. This known technique, however, does not achieve satisfactory reduction of common mode impedance in certain situations. According to another known technique, a conventional autotransformer may be wound on a toroidal core. The center tap of the autotransformer forms the common mode point for the DC bias circuitry, and the remaining two leads form the differential mode inductor. This known technique, however, is not suitable in certain situations.

It is generally desirable to have satisfactory reduction of common mode impedance in certain situations.

SUMMARY OF THE DISCLOSURE

In accordance with the present invention, disadvantages and problems associated with previous techniques for providing a differential mode inductor may be reduced or eliminated.

According to one embodiment of the present invention, a differential mode inductor includes a first inductor lead that receives a current. A first arm receives the current from the first inductor lead. A center tap receives the current from the first arm. A second arm receives the current from the center tap. The second arm is substantially parallel to the first arm. The current in the first arm flows in the same direction as the current in the second arm. A second inductor receives the current from the second arm.

Certain embodiments of the invention may provide one or more technical advantages. A technical advantage of one embodiment may be that the arms of a differential mode inductor may increase a net magnetic field in a differential mode and decrease the net magnetic field in a common mode. Accordingly, the differential mode inductor may have an increased ratio of a differential mode inductance to a common mode inductance.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION OF THE DRAWINGS

Embodiments of the present invention and its advantages are best understood by referring to FIGS. 1 through 4 of the drawings, like numerals being used for like and corresponding parts of the various drawings.

Figure 1:
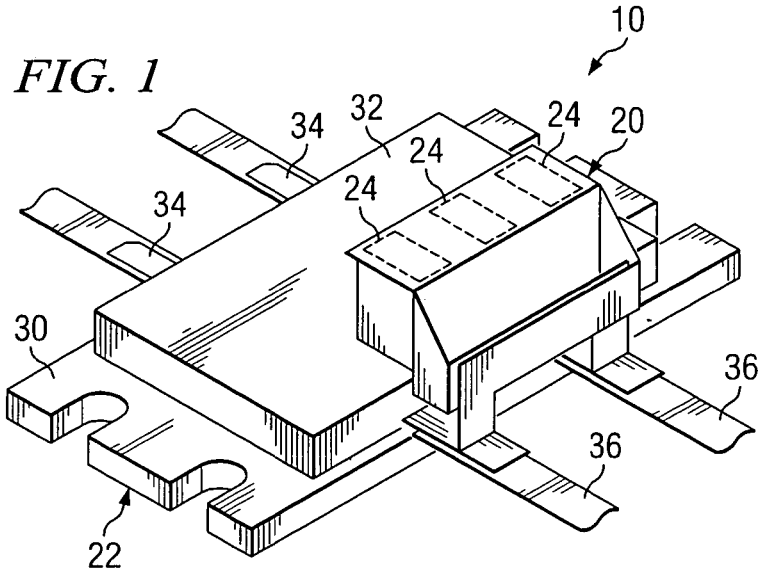
FIG. 1 is a perspectival view of one embodiment of a system that includes an example differential mode inductor according to one embodiment of the present invention.

FIG. 1 is a perspectival view of one embodiment of a system 10 that includes an example differential mode inductor 20 and a transistor 22. In general, differential mode inductor 20 couples the conductors of transistor 22. Differential mode inductor 20 may reduce common mode inductance by canceling at least some common mode currents.

According to the illustrated embodiment, system 10 includes differential mode inductor 20 coupled to transistor 22 as shown. A transistor comprises a semiconductor device capable of operations such as amplification, oscillation, and switching. A transistor typically includes one or more input electrodes such as a base or gate and one or more output electrodes such as a collector or drain. According to the illustrated embodiment, transistor 22 comprises a push-pull transistor. A push-pull transistor includes two active devices with the inputs and outputs placed in phase opposition. In the output circuit, even harmonics are cancelled and odd harmonics are reinforced.

According to the illustrated embodiment, transistor 22 includes a substrate 30, a case 32, input transistor leads 34, and output transistor leads 36 coupled as shown. Substrate 30 may comprise a semiconductive material such as silicon. Layers and active devices are formed outwardly from substrate 30 to form transistor 22. Active devices may include input and output electrodes.

Case 32 operates to enclose the active devices of transistor 22. According to one embodiment, case 32 may be regarded as ground. According to another embodiment, ground may be extended outwardly from transistor 22. Input transistor leads 34 receive input and transmit the input to the electrodes of transistor 22. Output transistor leads 36 receive output from the electrodes of transistor 22 and transmit the output away from transistor 22. Input transistor leads 34 and output transistor leads 36 may comprise a conductive material such as metal.

Decoupling capacitors 24 provide a low-impedance path to ground, which may prevent undesired stray coupling among the circuits of system 10. Decoupling capacitor 24 may comprise any suitable passive circuit component that includes metal electrodes separated by a dielectric. Decoupling capacitors 24 may lead to bias circuitry for the output electrodes such as the drain or collector of transistor 22.

Differential mode inductor 20 operates as a differential mode inductor by coupling output transistor leads 36. Differential mode inductor 20 may be used to attain a broadband impedance match at the drain or collector of transistor 22. Differential mode inductor 20 may provide reduced common mode inductance by cancellation of at least some of the common mode currents. A reduced common mode impedance may reduce electrical memory. Differential mode inductor 20 is described in more detail with reference to FIGS. 2 through 4.

Differential mode inductor 20 may have any suitable placement within system 10 depending upon the features of system 10 such as the dimensions of transistor 22, the distance between output transistor leads 36, and the location of decoupling capacitors 24 with respect to output transistor leads 36. According to one embodiment, differential mode inductor 20 may be placed such that the distance between the coupling capacitors 24 and output transistor leads 36 is minimized.

System 10 may be used in any suitable application. For example, system 10 may be used in a power amplifier for a communication system such as a radio frequency (RF) multi-carrier system. System 10 may be used in a wideband very high frequency (VHF) or ultra high frequency (UHF) power amplifier.

Modifications, additions, or omissions may be made to system 10 without departing from the scope of the invention. Moreover, the operations of system 10 may be performed by more, fewer, or other modules. As used in this document, "each" refers to each member of a set or each member of a subset of a set.

Figure 2:
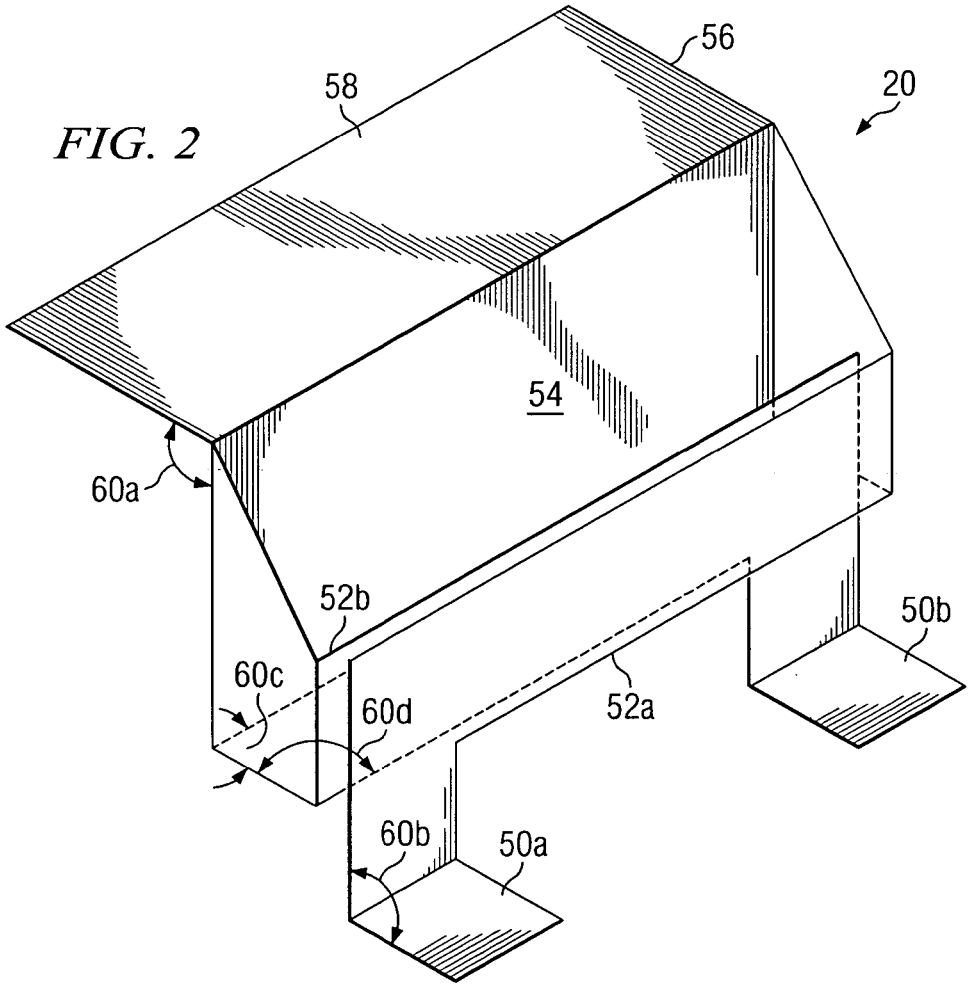
FIG. 2 is a perspectival view of an embodiment of a differential mode inductor that may be used with the system of FIG. 1.

FIG. 2 is a perspectival view of the embodiment of differential mode inductor 20 that may be used with system 10 of FIG. 1. According to the illustrated embodiment, differential mode inductor 20 includes inductor leads 50, arms 52, a panel 54, and a center tap 56 with a common mode point 58 coupled as shown. Angles 60 may be of any suitable value, such as approximately 90°. Differential mode inductor 20 may comprise any suitable conductive material that is capable of conducting the currents of system 10. For example, differential mode inductor 20 may comprise copper that is capable of conducting high frequency currents typical for radio frequency transistors. Differential mode inductor 20 may be formed from a substantially flat sheet of material such that inductor leads 50, arms 52, panel 54, center tap 56, and common mode point 58 comprise substantially flat, or planar, portions.

According to the illustrated embodiment, inductor leads 50 transmit currents to and from output transistor leads 36. Arm 52*a* may be substantially parallel to arm 52*b*, and may be in close proximity to generate mutual coupling. The distance between arms 52 may be any suitable distance such as 0.001 to 0.005 inches such as approximately 0.002 inches. A dielectric material such as a polyimide film or a glass-epoxy sheet may be used between arms 52 to maintain a close proximity without shorting arms 52 together. Arms 52 run in opposite directions such that a differential mode current in arm 52*a* flows in the same direction as the current in arm 52*b*. Center tap 56 transmits current to and from decoupling capacitors 24, and has a common mode point 58 coupled to the bias circuitry of the drain or collector of transistor 22.

The mutual coupling generated in arms 52 may increase the differential mode inductance. If arms 52 receive out-of-phase input from output transistor leads 36, the resulting magnetic fields tend to add, thus generally increasing the net magnetic field. The differential voltages from output transistor leads 36 are out-of-phase, thus yielding an increased net magnetic field and an increased differential mode inductance. The differential mode inductance may aid the output matching circuitry to achieve a broadband low impedance match at the drain or collector of transistor 22. The differential mode inductance may be tuned by adjusting the geometry and size of differential mode inductor 20 such as the proximity of arms 52 and panel 54 with respect to common mode point 56.

The mutual coupling may also decrease the common mode inductance at baseband frequencies. If arms 52 receive in-phase input from output transistor leads 36, the resulting magnetic fields tend to cancel, thus generally reducing the net magnetic field. The baseband envelope is in-phase at output transistor leads 26, thus yielding a decreased net magnetic field and a decreased common mode inductance. Reducing inductance internal to decoupling capacitors 24 and the inductance leading to decoupling capacitors 24 may reduce common mode impedance at the drain or collector of transistor 22, which may also reduce electrical memory. The common mode inductance may be tuned by the geometry and size of differential mode inductor 20.

Modifications, additions, or omissions may be made to differential mode inductor 20 without departing from the scope of the invention. For example, the shape, size, geometry, or any combination of the preceding may be changed according to certain needs or applications.

Figure 3:
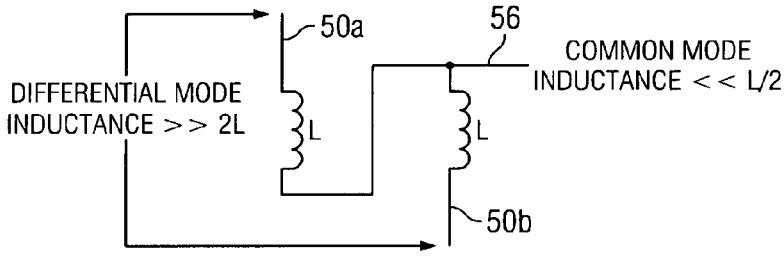
FIG. 3 is a circuit diagram of the embodiment of the differential mode inductor of FIG. 2.

FIG. 3 is a circuit diagram of the embodiment of differential mode inductor 20 of FIG. 2. According to the illustrated embodiment, L represents the inductance of each of the arms 52, which are coupled to inductor leads 50 and common mode point 56. The differential mode inductance measures inductance between inductor leads 50, and the common mode inductance measures inductance between inductor leads 50 and common mode point 56. The differential mode inductance is greater than 2×L, while the common mode inductance is less than L/2. Accordingly, the ratio of the differential mode inductance to the common mode inductance is greater than 4:1. For example, the ratio may be greater than 5:1, 6:1, or 7:1, or even as high as 8:1.

Figure 4:
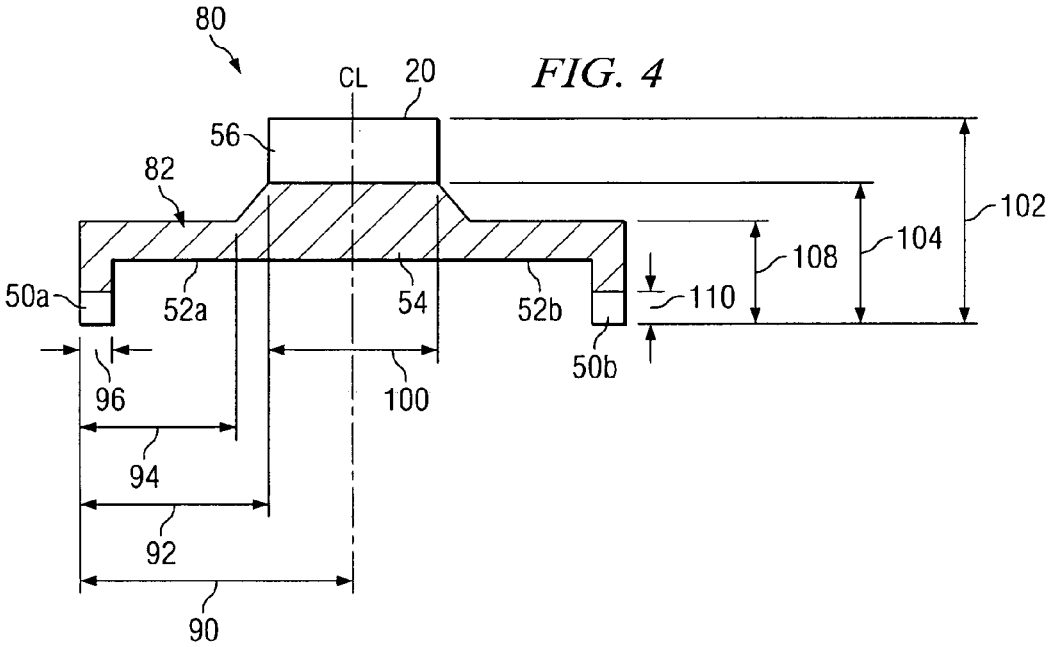
FIG. 4 is a diagram illustrating example dimensions of the embodiment of the differential mode inductor of FIG. 2.

FIG. 4 is a diagram 80 illustrating example dimensions of the embodiment of differential mode inductor 20 of FIG. 2. To more easily describe the example dimensions of differential mode inductor 20, differential mode inductor 20 is shown as unfolded and flattened. The example dimensions are provided for illustration purposes only. Other suitable values for the example dimensions may be used. For example, differential mode inductor 20 may be scaled to be larger or smaller to fit a differently sized transistor based on power, frequency, or both.

Center line CL designates a central axis that divides differential mode inductor 20 into approximately equivalent portions. A mid-length 90 may be approximately 0.75 to 0.95 inches such as approximately 0.86 inches. A length 92 may be approximately 0.50 to 0.70 inches such as approximately 0.60 inches. An arm length 94 may be approximately 0.40 to 0.60 inches such as approximately 0.50 inches. A lead width 96 may be approximately 0.050 to 0.15 inches such as approximately 0.10 inches. A panel length 100 may be approximately 0.40 to 0.60 inches such as approximately 0.52 inches.

A total height 102 may be approximately 0.55 to 0.75 inches such as approximately 0.65 inches. A height 104 may be approximately 0.35 to 0.55 inches such as approximately 0.45 inches. A height 108 may be approximately 0.20 to 0.40 inches such as approximately 0.32 inches. A lead length 110 may be approximately 0.050 to 0.15 inches such as approximately 0.10 inches. Differential mode inductor 20 may be formed from a flat sheet of any suitable thickness such as approximately 0.001 to 0.03 inches, for example, approximately 0.005 inches.

Differential mode inductor 20 includes an insulated portion 82. Insulated portion 82 may be insulated such that a dielectric material is placed between arms 52*a* and 52*b*. The dielectric material may reduce the probability of arms 52 shorting.

Certain embodiments of the invention may provide one or more technical advantages. A technical advantage of one embodiment may be that the arms of a differential mode inductor may increase a net magnetic field in a differential mode and decrease the net magnetic field in a common mode. Accordingly, the differential mode inductor may have an increased ratio of a differential mode inductance to a common mode inductance.

While this disclosure has been described in terms of certain embodiments and generally associated methods, alterations and permutations of the embodiments and methods will be apparent to those skilled in the art. Accordingly, the above description of example embodiments does not constrain this disclosure. Other changes, substitutions, and alterations are also possible without departing from the spirit and scope of this disclosure, as defined by the following claims.

What is claimed is:

1. A differential mode inductor, comprising:

a first inductor lead operable to receive a current;

a first arm coupled to the first inductor lead, the first arm operable to receive the current from the first inductor lead;

a center tap coupled to the first arm, the center tap operable to receive the current from the first arm;

a second arm coupled to the center tap, the second arm operable to receive the current from the center tap, the second arm substantially parallel to the first arm, the current in the first arm flowing in the same direction as the current in the second arm; and a second inductor lead coupled to the second arm, the second inductor lead operable to receive the current from the second arm.

2. The inductor of claim 1, wherein the center tap is coupled to bias circuitry associated with an output electrode of a transistor.

3. The inductor of claim 1, further comprising a dielectric material disposed between the first arm and the second arm.

4. The inductor of claim 1, wherein:

the first inductor lead is operable to be coupled to a first output lead of a push-pull transistor; and the second inductor lead is operable to be coupled to a second output lead of the push-pull transistor.

5. The inductor of claim 1, wherein:

the first inductor lead is operable to receive a first input; and the second inductor lead is operable to receive a second input, the first input in-phase with the second input, the first input generating a first magnetic field at the first arm, the second input generating a second magnetic field at the second arm, the first magnetic field opposing the second magnetic field.

6. The inductor of claim 1, wherein:

the first inductor lead is operable to receive a first input; and the second inductor lead is operable to receive a second input, the first input out-of-phase with the second input, the first input generating a first magnetic field at the first arm, the second input generating a second magnetic field at the second arm, the first magnetic field adding to the second magnetic field.

7. The inductor of claim 1, wherein:

the first arm comprises a first substantially flat portion; and the second arm comprises a second substantially planar portion, the first planar portion substantially parallel to the second planar portion.

8. The inductor of claim 1, wherein the center tap comprises a substantially planar portion.

9. The inductor of claim 1, wherein a ratio of a differential mode inductance to a common mode inductance is greater than four to one.

10. A differential mode inductor, comprising:

a first inductor lead operable to receive a current, the first inductor lead operable to be coupled to a first output lead of a push-pull transistor;

a first arm coupled to the first inductor lead, the first arm operable to receive the current from the first inductor lead, the first arm comprising a first substantially flat portion;

a center tap coupled to the first arm, the center tap operable to receive the current from the first arm, the center tap coupled to bias circuitry associated with an output electrode of the push-pull transistor, the center tap comprising a third substantially planar portion;

a second arm coupled to the center tap, the second arm operable to receive the current from the center tap, the second arm substantially parallel to the first arm, the current in the first arm flowing in the same direction as the current in the second arm, the second arm comprising a second substantially planar portion, the first planar portion substantially parallel to the second planar portion;

a dielectric material disposed between the first arm and the second arm; and a second inductor lead coupled to the second arm, the second inductor lead operable to receive the current from the second arm, the second inductor lead operable to be coupled to a second output lead of the push-pull transistor, wherein:

the first inductor lead is operable to receive a first input;

the second inductor lead is operable to receive a second input, the first input in-phase with the second input, the first input generating a first magnetic field at the first arm, the second input generating a second magnetic field at the second arm, the first magnetic field opposing the second magnetic field;

the first inductor lead is operable to receive a third input;

the second inductor lead is operable to receive a fourth input, the third input out-of-phase with the fourth input, the third input generating a third magnetic field at the first arm, the fourth input generating a fourth magnetic field at the second arm, the third magnetic field adding to the fourth magnetic field; and a ratio of a differential mode inductance to a common mode inductance is greater than four to one.

* * * * *